United States Patent [19]

Matsumori et al.

[11] Patent Number: 4,787,342

[45] Date of Patent: Nov. 29, 1988

[54] V-6 ENGINE

[75] Inventors: Yoshiro Matsumori; Takashige Tokushima, both of Hiroshima, Japan

[73] Assignee: Mazda Motor Corporation, Hiroshima, Japan

[21] Appl. No.: 39,235

[22] Filed: Apr. 17, 1987

[30] Foreign Application Priority Data

Apr. 18, 1986 [JP] Japan ..... 61-90218

[51] Int. Cl.[4] ..... F02B 75/22

[52] U.S. Cl. ..... 123/55 VS; 123/55 V; 123/52 MV

[58] Field of Search ..... 123/315, 90.27, 55 R, 123/55 VF, 55 VS, 55 V, 55 VE, 90.24, 90.44, 52 M, 52 MV

[56] References Cited

U.S. PATENT DOCUMENTS 1,722,950 7/1929 Barkeij ..... 123/55 VS
1,911,874 5/1933 Barkeij ..... 123/55 V
2,963,009 12/1960 Dolza ..... 123/55 VS
4,363,300 12/1982 Honda ..... 123/315

FOREIGN PATENT DOCUMENTS 0081250 5/1983 Japan .

*Primary Examiner*—Willis R. Wolfe
*Assistant Examiner*—M. Macy
*Attorney, Agent, or Firm*—Gerald J. Ferguson, Jr.

[57] ABSTRACT

A V-6 engine has left and right cylinder banks which have three cylinders each and are set to each other at an angle $\alpha$ not larger than about 30°. The positions of the crankpins for connecting the pistons in the respective cylinders with the crankshaft are so arranged that the crankpins for the three cylinders in each cylinder bank are positioned to differ from each other in phase by 120°, and the crankpins for each pair of cylinders which are symmetrically disposed with respect to the longitudinal center C of the crankshaft are positioned to differ from each other in phase by the angle $\alpha$ so that the pistons in the cylinders of each pair reach the respective top dead centers simultaneously.

10 Claims, 5 Drawing Sheets

| TYPE | CRANKPIN POSITION | CRANKSHAFT | LONGITUDINAL UNBALANCED COUPLE OF FORCES (MAX. MOMENT/ $mr\omega^2$. ONE BANK CYL-PITCH) | | | | |
|---|---|---|---|---|---|---|---|
| | | | 1-DIM | 2-DIM | 4-DIM | 1-DIM+4-DIM | |
| 60° V6 |  |  | 0 | 100 | 1.6 | 101.6 |   |
| | | | | ($\ell/r=4$) | | | |
| 90° V6 |  |  | 119.5 | 141.4 | 2.2 | 258.8 |   |
| | | | | ($\ell/r=4$) | | | |
| 75° V6 |  |  | 60.3 | 121.8 | 1.9 | 180.1 |   |
| | | | | ($\ell/r=4$) | | | |
| 15° V6 |  |  | 60.3 | 30.1 | 0.5 | 85.1 |   |
| | | | | ($\ell/r=4$) | | | |

V-6 ENGINE

BACKGROUND OF THE INVENTION

1. Field of the Invention

This invention relates to a V-6 engine in which a pair of cylinder banks are set at no larger than about 30° to each other.

2. Description of the Prior Art

In V-6 engines, the cylinder banks are generally set at 60° or 90° to each other, and the six cylinders are divided into three pairs, that is, the number 1 and number 4 cylinders are paired, the number 2 and number 5 cylinders are paired, and the number 3 and number 6 cylinders are paired, and the pistons for the cylinders of each pair are designed to reach the top dead center simultaneously. This permits the crankshaft to be designed to be symmetrical about a point and firing to occur at equal intervals, thereby minimizing moment of inertia and torque fluctuation.

Further, it has been proposed to theoretically nullify the linear moment in a V-type engine having an even number of cylinders by setting the relation between the crankpin's relative angle $\beta$ and the cylinder's included angle (the angle at which the cylinder banks are set to each other) $\alpha$ to satisfy formula $2\alpha-\beta=180°$. (See Japanese Unexamined Patent Publication No. 58(1983)-81250, for example.)

In V-6 engines, in order to satisfy the formula while realizing equal interval firing, the cylinder ∝s included angle $\alpha$ must be set to 60°. In the case of V-6 engines having a cylinder's included angle $\alpha$ substantially equal to 30° or smaller than 30°, the torque fluctuation and the moment of inertia are increased even if the crankpin positions are determined in accordance with the characteristics described above.

The V-6 engine having the cylinder's included angle of not larger than about 30° is advantageous in that it has both merits that the cylinder head can be formed in one piece and that the overall length of the engine can be shortened, the former being inherent to in-line engines and the latter being inherent to V-type engines, and in that the overall length and the width of the engine can be set to desired values. Accordingly, there is a great demand for a V-6 engine in which the cylinder's included angle is not larger than about 30°, and in which the torque fluctuation is reduced and the unbalanced moment of inertia is minimized.

SUMMARY OF THE INVENTION

In view of the foregoing observations and description, the primary object of the present invention is to provide a V-6 engine which can satisfy the above requirements.

In accordance with the present invention, the positions of the crankpins are so arranged that the crankpins for the three cylinders in each cylinder bank are positioned to differ from each other in phase by 120°, and the crankpins for each pair of cylinders which are symmetrically disposed with respect to the longitudinal center C of the crankshaft are positioned to differ from each other in phase by the bank angle $\alpha$ so that the pistons in the cylinders of each pair reach the respective top dead centers simultaneously.

More specifically, the crankpins respectively for the number 3 and number 4 cylinders differ from each other in phase by the bank angle $\alpha$, the crankpins respectively for the number 1 and number 2 cylinders differ from each other in phase by $120°+\alpha$ or by $-120°+\alpha$, and the crankpins respectively for the number 5 and number 6 cylinders differ from each other in phase by $-120°+\alpha$ or by $120°+\alpha$.

DESCRIPTION OF THE PREFERRED EMBODIMENT

Figure 1:
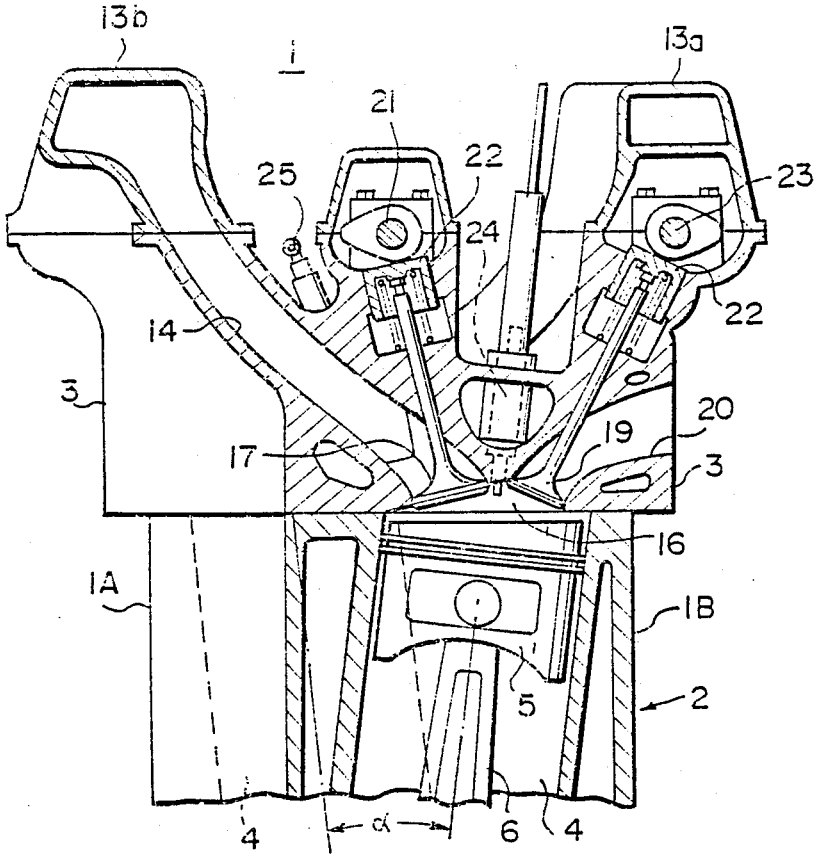
FIG. 1 is a fragmentary cross-sectional view showing a part of a V-6 engine in accordance with an embodiment of the present invention.
Figure 2:
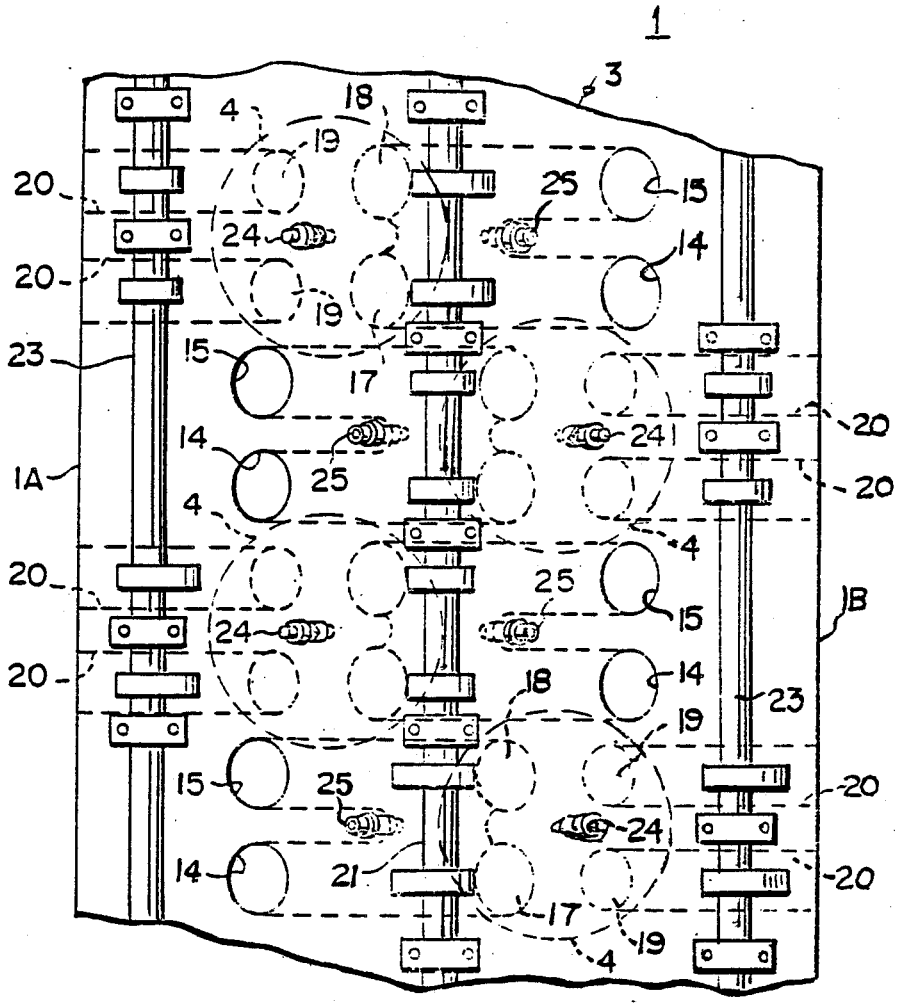
FIG. 2 is a fragmentary plan view of the V-6 engine.

In FIGS. 1 and 2, a V-6 engine 1 comprises a cylinder block 2 and a cylinder head 3 fixedly mounted on the cylinder block 2. In the engine 1, six cylinders 4 (4*a* to 4*b*) are formed to be inclined with respect to the vertical alternately in opposite directions, thereby forming left and right cylinder banks 1A and 1B. In each of the cylinders 4 is slidably received a piston 5 which is connected to a crankpin 8 (8*a* to 8*f*) (FIG. 4) on a crankshaft 7 by way of a connecting rod 6. The angle $\alpha$ between the sliding direction of the piston 5 in each cylinder 4 of the left cylinder bank 1A and that of the piston 5 in each cylinder 4 of the right cylinder bank 1B (said angle $\alpha$ being sometimes referred to as "the cylinder's included angle" or "the bank angle") is smaller than about 30° (15° in this particular embodiment), and the cylinder heads for the left and right cylinder banks 1A and 1B are formed in one piece (indicated at 3).

Each of the cylinders 4 in the left cylinder bank 1A is communicated with a surge tank 13*a* formed above the right cylinder bank 1B by way of primary and secondary intake passages 14 and 15, and similarly each of the cylinders 4 in the right cylinder bank 1B is communicated with a surge tank 13*b* formed above the left cylinder bank 1A by way of primary and secondary intake passages 14 and 15. The primary and secondary intake passages 14 and 15 are provided with primary and secondary intake valves 17 and 18 at openings through which the primary and secondary intake passages 14 and 15 open to the combustion chamber 16 formed in each cylinder 4. A pair of exhaust passages 20 extend from each cylinder 4 and open in the outer sides of the cylinder bank corresponding to the cylinder, and each of the exhaust passages 20 is provided with an exhaust valve 19.

The primary intake valves 17 and the secondary intake valves 18 of the cylinder banks 1A and 1B are driven by a first camshaft 21 disposed in the middle portion between the cylinder banks 1A and 1B by way of tappets 22. The exhaust valves 19 of the left and right cylinder banks 1A and 1B are driven by second camshafts 23 respectively disposed on opposite sides of first camshaft 21 by way of tappets 22.

A spark plug 24 is provided in each combustion chamber 6, and a fuel injection nozzle 25 is provided for each cylinder 4 at the downstream end portions of the primary and secondary intake passages 14 and 15 where the intake passages are communicated with each other.

Figure 3:
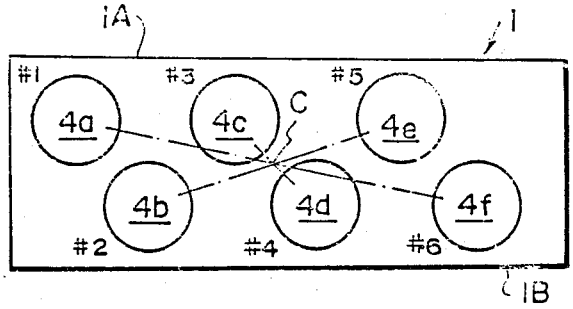
FIG. 3 is a schematic plan view for illustrating the cylinder pairs.
Figure 4:
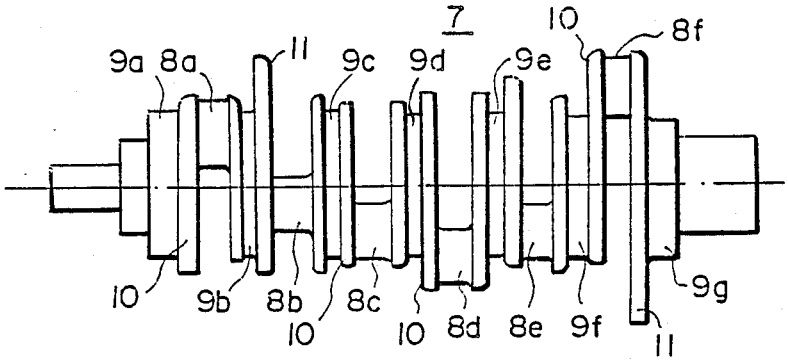
FIG. 4 is a side view showing the crankshaft employed in the engine shown in FIG. 1.
Figure 5:
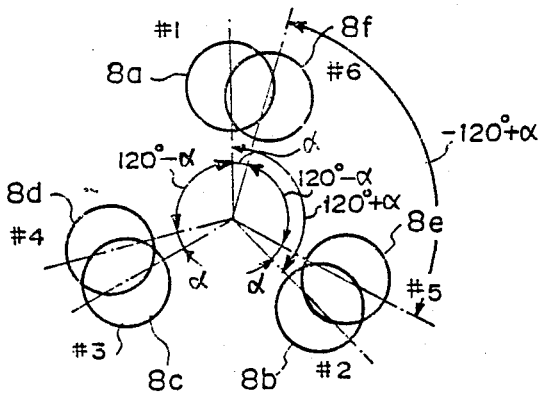
FIG. 5 is a schematic view showing the crankpin positions employed in the engine shown in FIG. 1.

As shown in FIG. 3, the number 1, number 3 and number 5 cylinders 4a, 4c and 4e are disposed in the left cylinder bank 1A and the number 2, number 4 and number 6 cylinders 4b, 4d and 4f are disposed in the right cylinder bank 1B. Corresponding to the arrangement of the number 1 to number 6 cylinders 4a to 4f, the crankpins 8a to 8f are provided on the crankshaft 7 as shown in FIGS. 4 and 5. That is, the crankshaft 7 is provided with journal portions 9a to 9g at inter-cylinder portions and opposite end portions thereof, and the crankpins 8a to 8f are respectively provided on the crankshaft 7 at portions opposed to the center of the cylinders 4a to 4f between the corresponding adjacent pairs of journal portions. To each of the crankpins 8 is connected the larger end portion of the connecting rod 6. The crankshaft 7 is further provided with webs 10 connecting the journal portions 9a to 9g and the crankpins 8a to 8g, and counterweights 11.

As clearly shown in FIGS. 3 and 5, the crankpins 8a to 8f are positioned so that the pistons 5 in each pair of cylinders which are symmetrically disposed with respect to the longitudinal center C of the crankshaft 7 reach the respective top dead centers simultaneously, i.e., so that the pistons 5 in the number 1 and number 6 cylinders 4a and 4f simultaneously reach the respective top dead centers, the pistons 5 in the number 2 and number 5 cylinders 4b and 4e simultaneously reach the respective top dead centers, and the pistons 5 in the number 3 and number 4 cylinders 4c and 4d simultaneously reach the respective top dead centers. That is, the crankpins 8a and 8f are positioned to differ from each other in phase by the bank angle $\alpha$, the crankpins 8b and 8e are positioned to differ from each other in phase by the bank angle $\alpha$ and the crankpins 8c and 8d are positioned to differ from each other in phase by the bank angle $\alpha$.

Further, the crankpins 8a, 8c and 8e for the cylinders 4a, 4c and 4e in the left cylinder bank 1A are positioned to differ from each other in phase by 120°, and the crankpins 8b, 8d and 8f for the cylinders 4b, 4d and 4f in the right cylinder banks 1B are positioned to differ from each other in phase by 120°.

That is, assuming that the pistons 5 in the cylinders of the left cylinder bank 1A reach the respective top dead centers in the order of 1-5-3 in response to rotation of the crankshaft 7 as shown in FIG. 5, the crankpins 8c and 8d respectively for the number 3 and number 4 cylinders 4c and 4d differ from each other in phase by the bank angle $\alpha$, the crankpins 8a and 8b respectively for the number 1 and number 2 cylinders 4a and 4b differ from each other in phase by $120° + \alpha$, and the crankpins 8e and 8f respectively for the number 5 and number 6 cylinders 4e and 4f differ from each other in phase by $-120° + \alpha$.

In this case, the equal interval firing can be realized by setting the firing order so that the cylinders of said each pair are alternately fired at predetermined timings corresponding to the timings at which the pistons therein reach the respective top dead centers. For example, in the case that the cylinders in the left cylinder bank 1A and the cylinders in the right cylinder bank 1B are alternately fired, the firing order may be 1-2-3-6-5-4, or 1-5-4-6-2-3.

Figure 6:
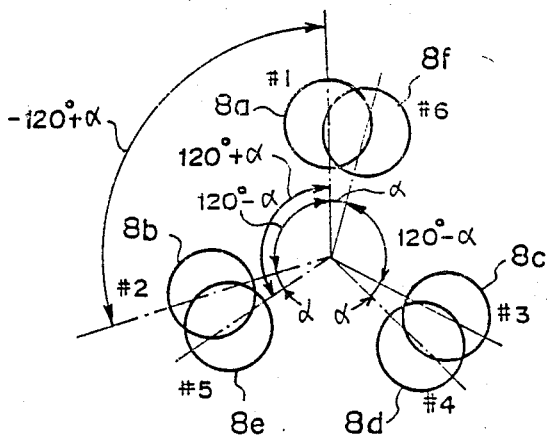
FIG. 6 is a view similar to FIG. 5 but showing the crankpin positions of an engine in accordance with another embodiment of the present invention.

Further, assuming that the pistons 5 in the cylinders of the left cylinder bank 1A reach the respective top dead centers in the order of 1-3-5 in response to rotation of the crankshaft 7 as shown in FIG. 6, the crankpins 8c and 8d respectively for the number 3 and number 4 cylinders 4c and 4d differ from each other in phase by the bank angle $\alpha$, the crankpins 8a and 8b respectively for the number 1 and number 2 cylinders 4a and 4b differ from each other in phase by $-120° + \alpha$, and the crankpins 8e and 8f respectively for the number 5 and number 6 cylinders 4e and 4f differ from each other in phase by $120° + \alpha$.

Also in this case, the equal interval firing can be realized in a similar manner. For example, in the case that the cylinders in the left cylinder bank 1A and the cylinders in the right cylinder bank 1B are alternately fired, the firing order may be 1-4-5-6-3-2, or 1-3-5 -6-4-2.

Figure 7:
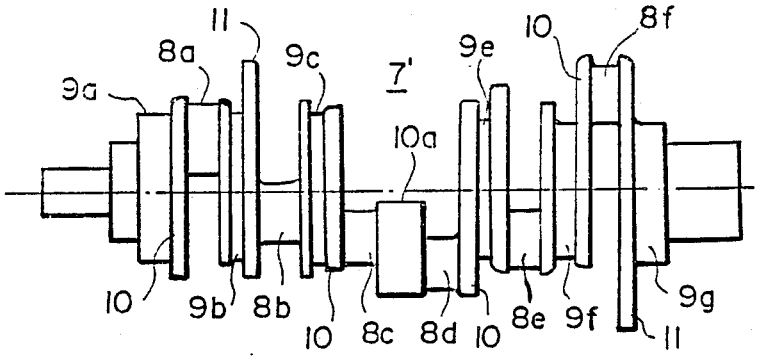
FIG. 7 is a side view of the crankshaft conforming the crankpin positions shown in FIG. 6.

When forming the crankshaft to conform to the crankpin positions shown in FIG. 6, the journal portion 9d between the number 3 cylinder and the number 4 cylinder can be omitted since the phase difference between the crankpins 8c and 8d is equal to the bank angle $\alpha$ and is small. That is, as shown in FIG. 7, even if the crankpins 8c and 8d are connected together directly by the web 10a, sufficient rigidity can be ensured. This simplifies the structure of the crankshaft 7' for the crankpin positions shown in FIG. 6. In FIG. 7, the parts analogous to the parts shown in FIG. 4 are given the same reference numerals and will not be described here.

Figure 8:
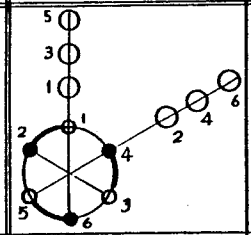
FIG. 8 is a table showing the longitudinal unbalanced couple of forces in a V-6 engine in accordance with an embodiment of the present invention in comparison with other V-type engines having the same bore/stoke.
Figure 8:
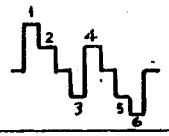
Figure 8:
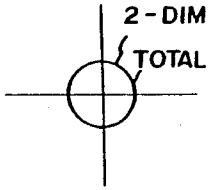
Figure 8:
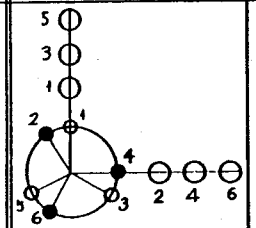
Figure 8:
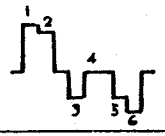
Figure 8:
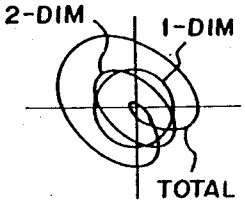
Figure 8:
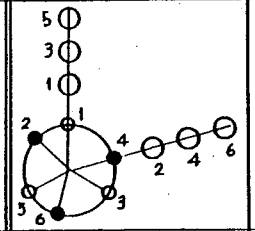
Figure 8:
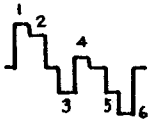
Figure 8:
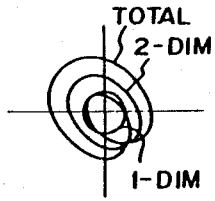
Figure 8:
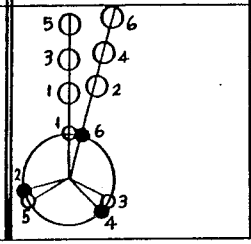
Figure 8:
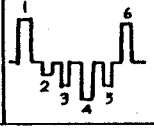
Figure 8:
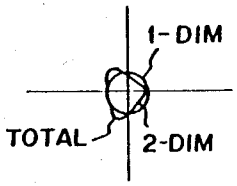

The table in FIG. 8 shows the longitudinal unbalanced couple of forces in a V-6 engine in accordance with an embodiment of the present invention in comparison with other V-type engines having the same bore/-stroke. The values in the table represent the unbalanced couple of forces when the two-dimensional unbalanced couple of forces in a V-6 engine having a cylinder's included angle of 60° is assumed to be 100, the valve 100 being a standard value (index) having no dimensions. The one bank cylinder pitch for the engine of the present invention is assumed to be the same as the other engines.

We claim:

1. A V-6 engine having left and right cylinder banks which have three cylinders each and are set to each other at an angle $\alpha$ not larger than about 30°, the piston for each cylinder being connected to a single crankshaft by way of crankpins, characterized in that the positions of the crankpins are so arranged that the crankpins for the three cylinders in each cylinder bank are positioned to differ from each other in phase by 120°, and the phase differences between the crankpins for a number 1 cylinder and a number 6 cylinder, between the crankpins for a number 2 cylinder and a number 5 cylinder and between the crankpins for a number 3 cylinder and a number 4 cylinder are equal to the angle $\alpha$ so that the pistons in the cylinders of each pair reach the respective top dead centers simultaneously with each other, the cylinders in the left cylinder bank and the cylinders in the right cylinder bank are alternately fired, only one intake camshaft driving intake valves for all of the cylinders, the intake and exhaust valves for each cylinder are arranged to form a V-shape, the exhaust port for each cylinder is disposed on the outer side of the corresponding cylinder bank, and the intake port for each cylinder of each cylinder bank is connected to a surge tank disposed on the other cylinder bank side;

the number 1, number 3 and number 5 cylinders are disposed in the left bank in this order and the number 2, number 4 and number 6 cylinders are disposed in the right bank in this order from an end of the engine toward the other end along the crankshaft direction, with the cylinders of the left and right banks being alternately arranged;

the one intake camshaft being disposed in the middle portion between the cylinder banks and having cams for driving the intake valves for the cylinders in the both cylinder banks, and a pair of exhaust camshafts disposed on the outer sides of the respective cylinder banks and provided with cams for driving the exhaust valves for the cylinders in the corresponding cylinder banks; and each of the cylinders has a pent roof type combustion chamber.

2. A V-6 engine as defined in claim 1 in which the crankpins respectively for the number 3 and number 4 cylinders differ from each other in phase by the bank angle $\alpha$, the crankpins respectively for the number 1 and number 2 cylinders differ from each other in phase by $120°+\alpha$, and the crankpins respectively for the number 5 and number 6 cylinders differ from each other in phase by $-120°+\alpha$.

3. A V-6 engine as defined in claim 1 in which the crankpins respectively for the number 3 and number 4 cylinders differ from each other in phase by the bank angle $\alpha$, the crankpins respectively for the number 1 and number 2 cylinders differ from each other in phase by $-120°+\alpha$, and the crankpins respectively for the number 5 and number 6 cylinders differ from each other in phase by $120°+\alpha$.

4. A V-type engine as defined in claim 1 in which the crankshaft is provided with journals between adjacent crankpins except between the crankpins for the number 3 cylinder and the number 4 cylinder.

5. A V-6 engine as defined in claim 1 in which a spark plug and a fuel injector are respectively disposed on opposite sides of the intake camshaft.

6. A V-6 engine as defined in claim 1 in which each intake passage for connecting the surge tank of each cylinder bank to each cylinder traverses the the space between the exhaust camshaft disposed on the same side as said cylinder bank and the intake camshaft, said surge tank being disposed above said exhaust camshaft.

7. A V-6 engine as defined in claim 6 in which said intake passage comprises primary and secondary intake passages.

8. A V-6 engine as defined in claim 7 in which said primary and secondary intake passages join together in the proximity of the intake valve disposed downstream thereof, and a fuel injector is disposed at this joining portion.

9. A V-6 engine as defined in claim 1, in which a spark plug and a fuel injector are respectively disposed on opposite sides of the intake camshaft in which each intake passage for connecting the surge tank of each cylinder bank to each cylinder traverses the space between the exhaust camshaft disposed on the same side as said cylinder bank and the intake camshaft, said surge tank being disposed above said exhaust camshaft.

10. A V-6 engine as defined in claim 1, in which a spark plug and a fuel injector are respectively disposed on opposite sides of the intake camshaft, in which each intake passage for connecting the surge tank of each cylinder bank to each cylinder traverses the space between the exhaust camshaft disposed on the same side as said cylinder bank and the intake camshaft, said surge tank being disposed above said exhaust camshaft, in which said intake passage comprises primary and secondary intake passages, and in which said primary and secondary intake passages join together in the proximity of the intake valve disposed downstream thereof, and a fuel injector is disposed at this joining portion.

* * * * *